US005547524A

United States Patent [19]

Sainfort et al.

[11] Patent Number: 5,547,524

[45] Date of Patent: Aug. 20, 1996

[54] HARDENED ALUMINUM ALLOY STOCK MATERIALS HAVING CONTINUOUS VARIATION IN PROPERTIES AND PROCESS FOR PRODUCING

[76] Inventors: Pierre Sainfort, 23 Bd. Maréchal Leclerc; Hervé Vichery, 14 Place Jean Moulin; Benoît Commet, 8, rue de l'Abbé Grégoire, all of 38000 Grenoble, France

[21] Appl. No.: 267,026

[22] Filed: Jun. 21, 1994

[30] Foreign Application Priority Data

Jun. 28, 1993 [FR] France ..... 93 08096

[51] Int. Cl.[6] ..... C22F 1/04

[52] U.S. Cl. ..... 148/688; 148/698; 148/437; 148/438; 148/439; 148/440; 148/902; 266/102; 266/103; 266/104

[58] Field of Search ..... 148/688, 437, 148/438, 439, 440, 902, 698; 266/102, 103, 104

[56] References Cited

U.S. PATENT DOCUMENTS 4,959,107 9/1990 Wallick, Jr. et al. ..... 148/688

FOREIGN PATENT DOCUMENTS 0196243 10/1986 European Pat. Off. .
0284876 10/1988 European Pat. Off. .
0514292 11/1992 European Pat. Off. .
8807595 10/1988 WIPO .

*Primary Examiner*—David A. Simmons
*Assistant Examiner*—Robert R. Koehler

[57] ABSTRACT

A planar sheet of structurally hardened aluminum alloy, having, after quenching and aging, mechanical strength which varies continuously in a particularly defined direction of the planar sheet. The planar sheet is produced in a process comprising quenching and final aging, where the final aging comprises heating for a defined period of time a first portion of the plate or sheet including a first edge to a first temperature T and a second portion of the plate or sheet including an opposite edge to a second temperature t<T.

11 Claims, 4 Drawing Sheets

HARDENED ALUMINUM ALLOY STOCK MATERIALS HAVING CONTINUOUS VARIATION IN PROPERTIES AND PROCESS FOR PRODUCING

BACKGROUND OF THE INVENTION

The invention concerns plates or sheets of Al alloys involving structural hardening and having a continuous variation in the properties of use in at least one given direction (D) whatever and a process and an apparatus for producing same.

In general the attempt in metallurgy is to obtain products whose properties are as homogenous as possible throughout the entire volume thereof.

However for some uses it is desirable to produce products whose properties, with a given chemical composition, vary continuously in at least one given direction (D).

For example, in a bee which is subjected to flexural forces and to fatigue it is desirable for the part which is under compression to have a high level of mechanical resistance to compression while the part subjected to tensile stress must be resistant to damage, in particular being of a lower level of hardness.

Likewise in a shock absorber it is desirable for the impact zone to be resilient and ductile whereas the opposite part must withstand the force applied.

More generally that problem arises in all situations where the product is subjected in service either to a severe gradient in terms of mechanical stresses or to heterogenous conditions of use (for example resistance to corrosion).

SUMMARY OF THE INVENTION

The invention therefore concerns plates or sheets of Al alloy involving structural hardening, in particular high-strength alloys of the series 2000 (Al—Cu) and 7000 (Al—Zn—Mg—Cu) whose properties after quenching and annealing vary continuously in at least one direction (D) which is parallel to one of the main dimensions (length, width and height).

The properties of use may be mechanical characteristics (ultimate stress, elastic limit, hardness, fatigue strength, tenacity, tolerance to damage etc. . .) but also for example resistance to corrosion. In the case of mechanical characteristics an interesting situation is that involving characteristics in the transverse, long or short direction.

The process for producing such products, after quenching and possible controlled plastic deformation, involves annealing in a thermal gradient of a direction (D) such as to obtain the desired characteristics in respect of each of the sides of the product in said direction (D), one of the sides being brought to a temperature T and the other side being brought to a temperature t<T, during the same period (d). The endeavour for example will be to have one side corresponding to the state T6(51) and the other side corresponding to the state T74(51).

The temperatures (T, t) and the duration (d) of the treatment can be easily determined by the man skilled in the art, either experimentally or by application of the laws of temperature/time equivalence which are well known in the field of annealing of Al alloys: for example it is possible to adopt the relationship $R_{0.2}=f\ (aT+b.\log d)$, T being the temperature in Kelvin and d being time, wherein the constants a and b can be determined by preliminary tests in regard to response to annealing of the alloy in question. The performance of that annealing treatment requires a furnace of specific structure comprising a hot chamber and a cold chamber, each thereof being regulated independently of the other, between which the product to be treated is placed.

The assembly is then heated at a given heating rate so as to attain the temperature T in the hot chamber and the temperature t in the cold chamber, and, once a steady-state condition has been substantially established, to maintain the assembly during the period d, and finally to remove the product which cools naturally to ambient temperature.

In a preferred version the cold chamber is connected to the hot chamber by way of a heat pump.

The modulated heating operation may also be effected by linear heating means (arrays of gas burners or devices for distributing jets of hot fluid, electrical resistors, etc. . .) which are regulated individually to a certain temperature or power, and which are disposed in the vicinity of the surface of the product and in a direction perpendicular to the direction (D).

Each hot or cold chamber can be subdivided into compartments at different temperatures, the temperature profile being adapted to the profile of the sheet, the edges of which are not necessarily parallel.

The invention will be better appreciated by reference to the following example which relates to a plate of alloy 7010 (in accordance with the designation of the Aluminum Association) which is 100 mm in thickness and of the following composition (in % by weight):

| Si | Fe | Cu | Mn | Mg | Zn | Ti | Zr |
|---|---|---|---|---|---|---|---|
| 0.06 | 0.01 | 1.68 | 0.01 | 2.32 | 5.99 | 0.03 | 0.11 |

The object was to obtain the state T651 at one end and the state T7451 at the other end.

DESCRIPTION OF THE PREFERRED EMBODIMENTS

Figure 1:
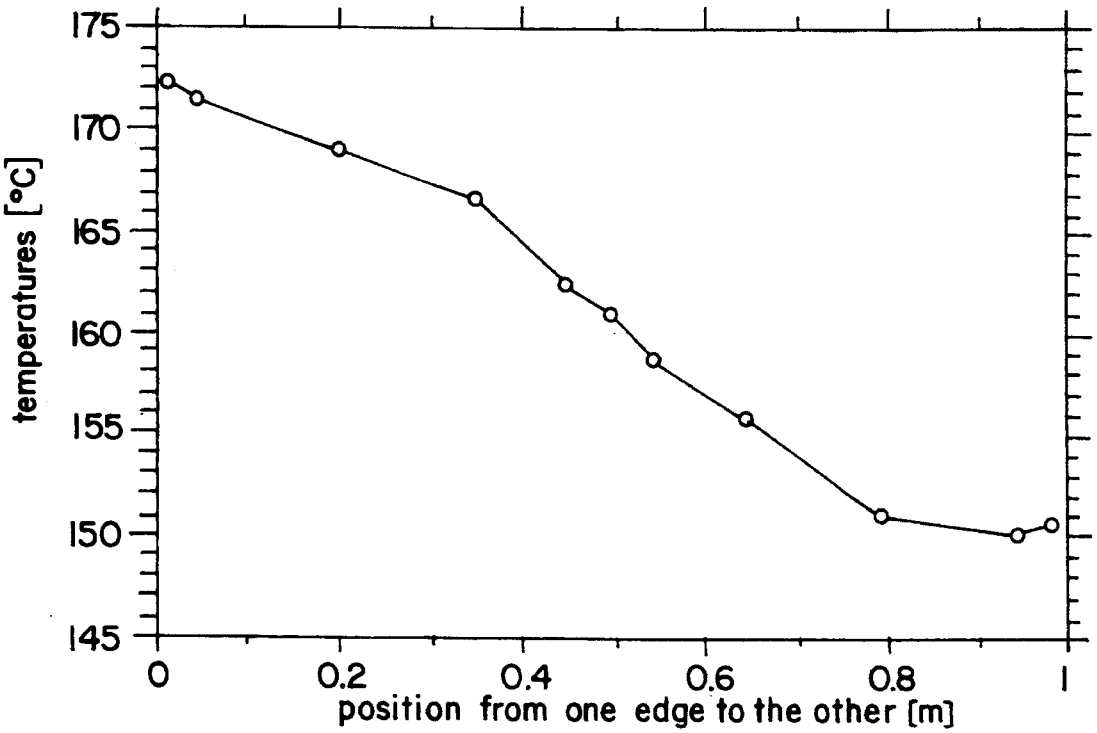
FIG. 1 shows the variation in the annealing temperature of the treated product (steady-state condition)

By application of the rules in respect of temperature/time equivalence and having regard to the rate of rise imposed by the furnace used (9 hours 45 minutes to attain 150° C.), it was found that for an isochronal treatment of 10 hours the temperature T of the product had to be 172° C. and its temperature t had to be 150° C. to obtain the states respectively corresponding to the conventional annealing treatments:

| | |
|---|---|
| T 651 | 9 hours at 155° C. |
| T 7451 | 6 hours at 115° C. + 10 hours at 172° C. |

The air furnace used is composed of two contiguous chambers, a hot chamber 1 and a cold chamber 2, which are separated by a removable insulating wall 3, the product to be treated being placed symmetrically between the chambers. That product is formed by a portion of plate of the dimensions 1000×400×100 mm corresponding respectively to the dimensions transverse long (Tl), long (L) and transverse short (TC). That product rests on a roller-type sole 5. The furnace is closed by two doors 6 and is provided with air circulating turbine fans 7 and temperature regulating systems (not shown).

Following preliminary tests on a plate of the same dimensions and of the same nature, the reference temperature of the chamber 1 was fixed at 183° C. and that of the chamber 2 was fixed at 141° C. and it was estimated that the steady-state condition was established when the temperature of the product in the chamber 2 reached 148° C.

Figure 2:
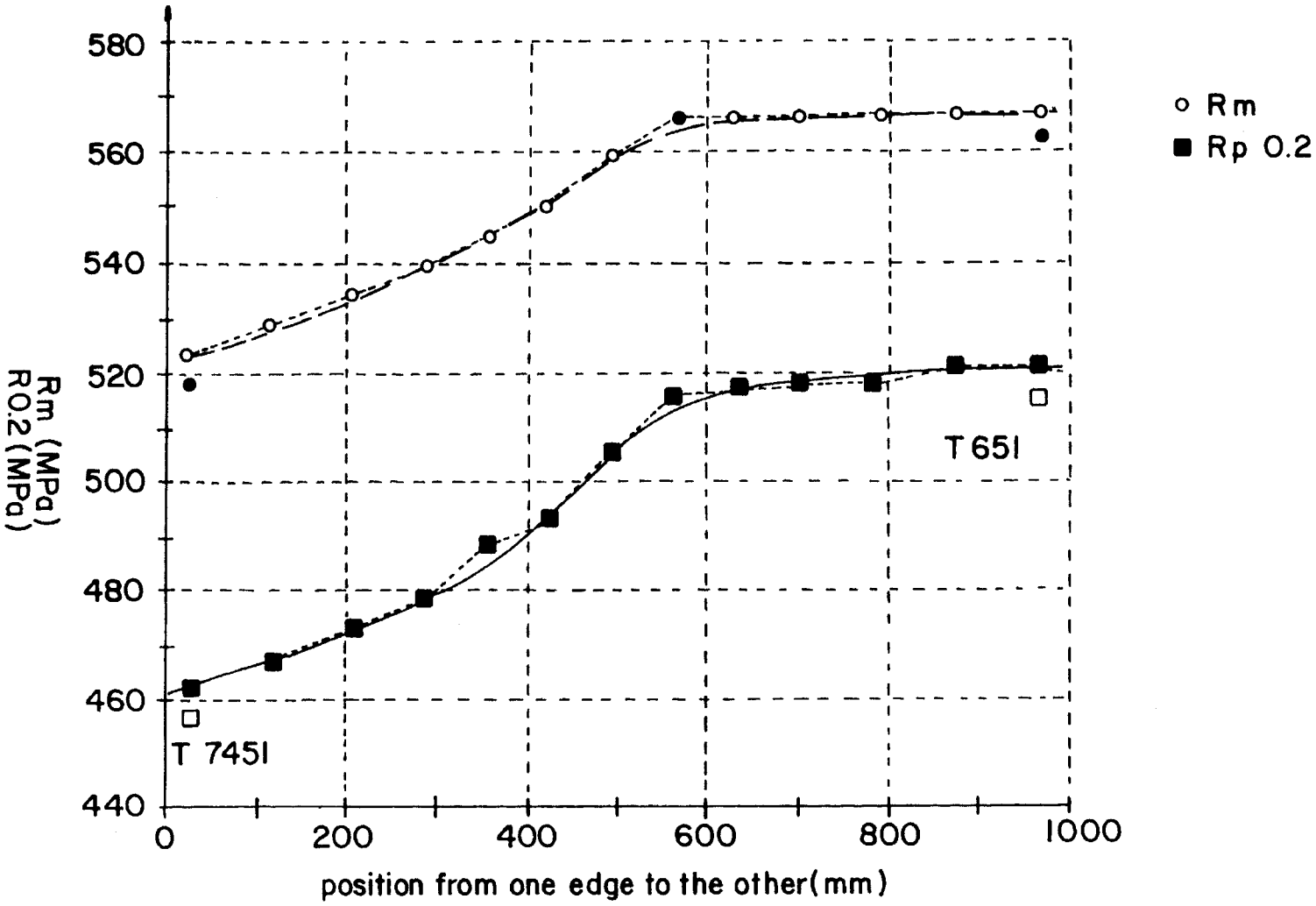
FIG. 2 shows the profile of the mechanical strength characteristics obtained.
Figure 3:
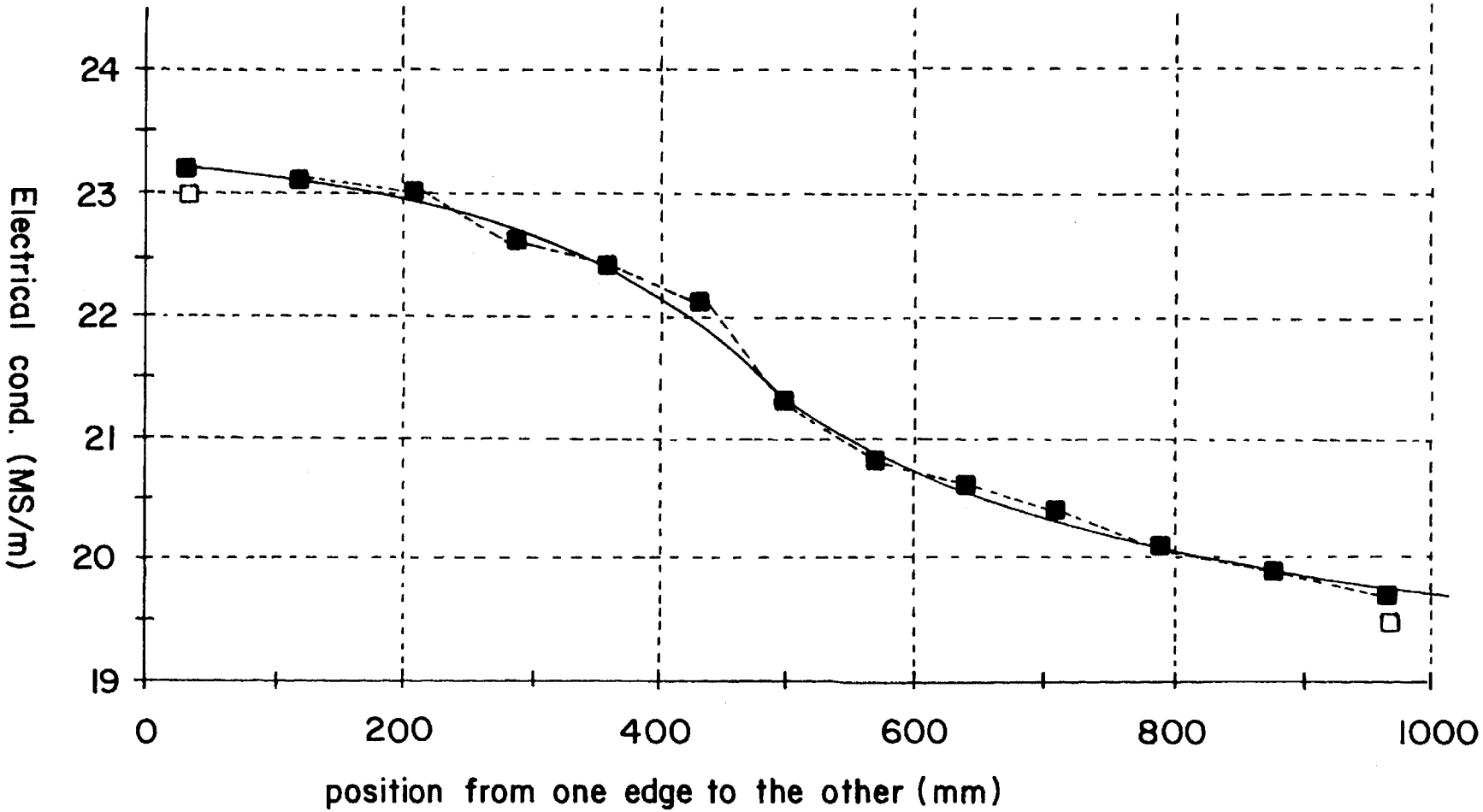
FIG. 3 shows the profile of surface electrical conductivities obtained.
Figure 4:
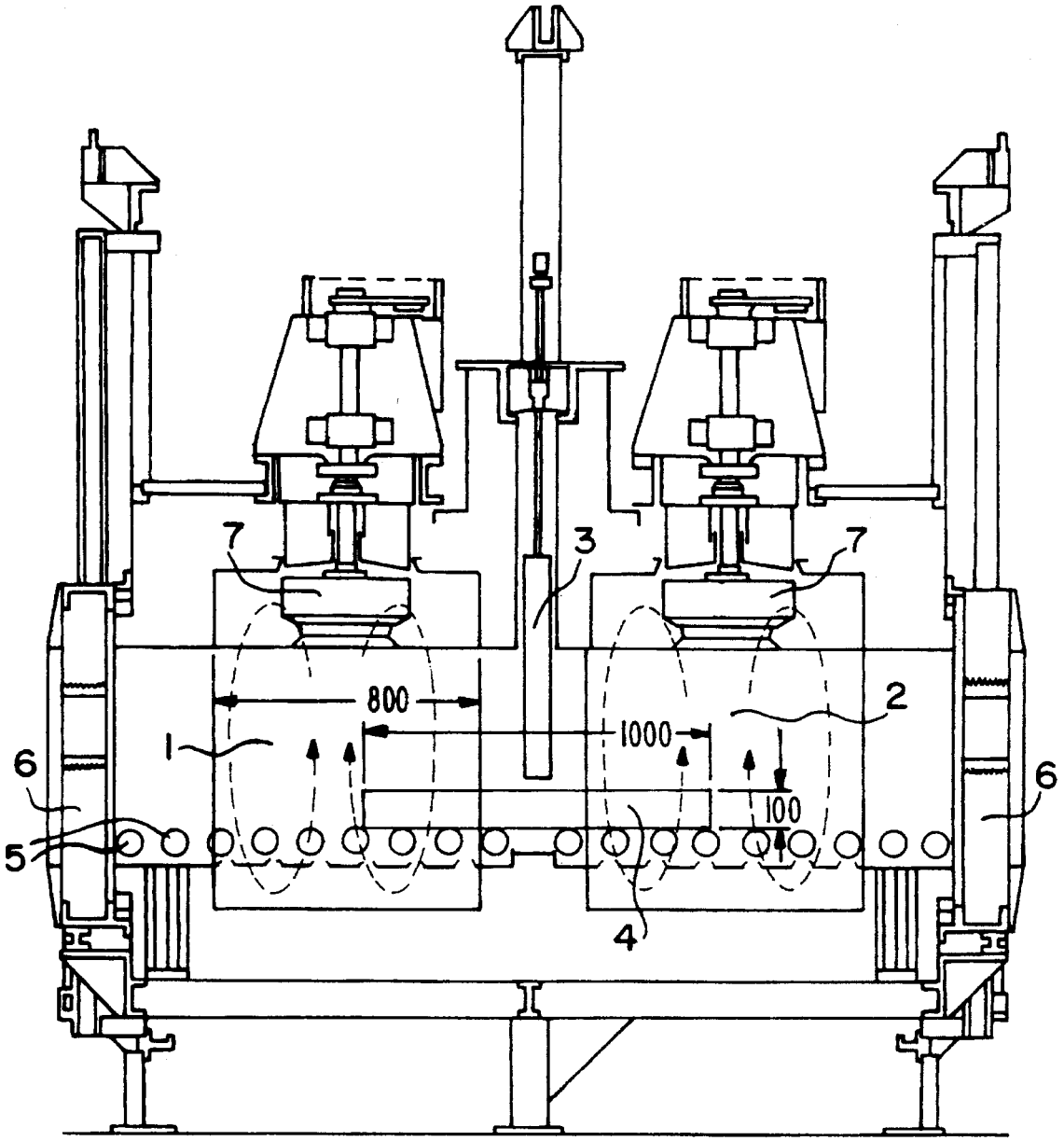
FIG. 4 is a diagrammatic view in section of the furnace used.

The results of monitoring the profile of the temperature in the direction of the length of the product as well as the variation in the mechanical tensile characteristics (direction of the length of the product, that is to say the metallurgical direction TL, ¼ of the thickness) and electrical surface conductivity of the product, are shown in Table 1 and in FIGS. 1 to 3. FIGS. 2 and 3 also show the points which are representative of conventional states T651 and T7451.

The product according to the invention can be used for the production of internal spars of aircraft aerofoils, in particular in the form of thick sheets of alloys of the series 2000 and the series 7000.

TABLE I

Mechanical characteristics and conductivity in the length of the sheet (TL)

| Distance* in mm | Surface conductivity (MS/m) | Rp 0.2 (MPa) ¼th. Ave. | Rm (MPa) ¼th. Ave. | E% ¼th. Ave. |
|---|---|---|---|---|
| 970 | 19.7 | 521 | 567 | 6.8 |
| 880 | 19.9 | 521 | 568 | 7.3 |
| 790 | 20.1 | 518 | 568 | 6.7 |
| 710 | 20.4 | 518 | 568 | 7 |
| 640 | 20.6 | 517 | 567 | 6.8 |
| 570 | 20.8 | 515 | 564 | 7 |
| 500 | 21.3 | 505 | 559 | 7.9 |
| 430 | 22.1 | 493 | 551 | 6.9 |
| 360 | 22.4 | 488 | 545 | 8.2 |
| 290 | 22.6 | 478 | 539 | 8.4 |
| 210 | 23 | 473 | 534 | 8.6 |
| 120 | 23.1 | 467 | 528 | 8.5 |
| 30 | 23.2 | 462 | 524 | 8.8 |

**Distance with respect to the end, hot zone side.

What is claimed is:

1. A process for producing a structurally hardened plate or sheet of aluminum alloy comprising quenching and final aging, said final aging comprising heating for a defined period of time a first portion of the plate or sheet including a first edge to a first temperature T, and a second portion of the plate or sheet including an opposite edge to a second temperature t<T, the plate or sheet having, after said final aging, mechanical properties which vary continuously from said first edge to said opposite edge.

2. A process according to claim 1, wherein the final aging is carried out by disposing linear heating means in a direction perpendicular to a direction (D) between said first edge and said opposite edge, the heating means being disposed in the vicinity of the plate or sheet to be treated.

3. A process for producing a structurally hardened plate or sheet of aluminum alloy comprising quenching and final aging, said final aging comprising passing the plate or sheet through a furnace having first and second chambers separated by a removable refractory partition, heating the first chamber to a first temperature, heating the second chamber to a second temperature, heating a first portion of the plate or sheet including a first edge to a first temperature T in the first chamber and heating a second portion of the plate or sheet including an opposite edge to a second temperature t<T in the second chamber, the plate or sheet of aluminum alloy obtained thereby having mechanical properties which vary continuously from said first edge to said opposite edge.

4. A process according to claim 3 additionally comprising subdividing each chamber into compartments of different temperatures.

5. A process for producing a structurally hardened plate or sheet of aluminum alloy comprising quenching and final aging, said final aging comprising passing the plate or sheet through a furnace having first and second chambers separated by a removable refractory partition, connecting a heat pump between the first and second chambers whereby the first chamber is heated to a first temperature and the second chamber is heated to a second temperature, heating a first portion of the plate or sheet including a first edge to a first temperature T in the first chamber and heating a second portion of the plate or sheet including an opposite edge to a second temperature t<T in the second chamber, the plate or sheet of aluminum alloy obtained thereby having mechanical properties which vary continuously to said first edge to said opposite edge.

6. A plate or sheet of structurally hardened aluminum alloy, having, after quenching and aging, mechanical strength which varies continuously in the transverse long or transverse short direction of the plate or sheet.

7. A plate or sheet according to claim 6 made of an alloy of the Aluminum Association series 2000 or the series 7000.

8. A plate or sheet of structurally hardened aluminum alloy of defined length, width and thickness, having, after quenching and aging, mechanical properties which vary continuously in a direction parallel to the length, width or thickness, from a first value at a first edge of the plate or sheet to a second value at an opposite edge of the plate or sheet.

9. A plate or sheet according to claim 8 made of an alloy of the Aluminum Association series 2000 or the series 7000.

10. A plate or sheet of structurally hardened aluminum alloy, having, after quenching and artificial, a first portion including a first edge having mechanical properties corresponding to a T651 state and an second portion including an opposite edge corresponding to a T7451 state, the mechanical properties of the plate or sheet varying continuously between said first edge and said opposite edge.

11. A plate or sheet according to claim 10 made of an alloy of the Aluminum Association series 2000 or the series 7000.

* * * * *